US005649481A

United States Patent [19]

Müller et al.

[11] Patent Number: 5,649,481

[45] Date of Patent: Jul. 22, 1997

[54] DAMPING UNIT FOR A PRINTING PRESS

[75] Inventors: Robert Müller, Heuchelheim; Helmut Puschnerat, Wachenheim; Günter Schmitt, Beindersheim, all of Germany

[73] Assignee: Koenig & Bauer-Albert Aktiengesellschaft, Wurzburg, Germany

[21] Appl. No.: 577,342

[22] Filed: Dec. 22, 1995

[30] Foreign Application Priority Data

Dec. 30, 1994 [DE] Germany ..... 44 47 178.5

[51] Int. Cl.[6] ..... B41L 25/02

[52] U.S. Cl. ..... 101/148; 101/147

[58] Field of Search ..... 101/148, 147

[56] References Cited

U.S. PATENT DOCUMENTS

| | | | |
|---|---|---|---|
| 3,106,154 | 10/1963 | Saul | 101/148 |
| 3,517,613 | 6/1970 | Schinke et al. | 101/148 |
| 4,558,642 | 12/1985 | Burger et al. | 101/148 |
| 5,067,401 | 11/1991 | Kusanagi | 101/148 |
| 5,191,835 | 3/1993 | Blanchard | 101/148 |
| 5,299,495 | 4/1994 | Schoeps et al. | 101/147 |

FOREIGN PATENT DOCUMENTS

| | | |
|---|---|---|
| 0 462 490 | 6/1991 | European Pat. Off. . |
| 27 45 330 | 7/1979 | Germany . |
| 41 25 012 | 1/1993 | Germany . |
| 2 082 121 | 3/1982 | United Kingdom . |

*Primary Examiner*—Edgar S. Burr
*Assistant Examiner*—Daniel Colilla
*Attorney, Agent, or Firm*—Jones, Tullar & Cooper, P.C.

[57] ABSTRACT

A damping unit for a printing press utilizes four rollers to provide damping medium from a source of the damping medium, to a printing plate cylinder. The various rollers in the damping unit are interrelated by appropriate diameter and circumferential speeds to effectively prevent the migration of printing ink back from the printing cylinder to the damping fluid source.

2 Claims, 1 Drawing Sheet

DAMPING UNIT FOR A PRINTING PRESS

FIELD OF THE INVENTION

The present invention is directed generally to a damping unit for a printing press. More particularly, the present invention is directed to a damping unit for a rotary printing press and which uses several cooperating rollers. Most specifically, the present invention is directed to a damping unit for a rotary printing press which utilizes a dipping roller, a transfer roller, a distribution roller and an application roller. The dipping roller and the distributing roller are hard surfaced rollers which are hydrophilic. The transfer roller and the application roller are both soft surfaced rollers that have rubber or other resilient surface coatings. The diameters of the rollers and their circumferential speeds are different from one another. The result is a damping unit that supplies damping fluid to the plate cylinder but that does not allow significant migration of ink back from the plate cylinder to the damping medium reservoir or supply.

DESCRIPTION OF THE PRIOR ART

Damping units are generally very well known in the rotary printing field. These units apply a damping medium, such as water, to the surface of printing plates carried on a plate cylinder. There are various spray damping units, brush damping units and the like. The most well known damping units typically utilize a roller train to transfer the damping medium fluid from a damping fluid reservoir to the plate or plates on the plate cylinder.

One prior art damping unit of the generally known roller train type is disclosed in German Patent Publication DE 27 45 330 A1. This damping unit consists of a dipping roller that partially immerses or dips into a damping medium box or reservoir. A transfer roller is in contact with the dipping roller and is also in contact with a damping fluid distribution roller. The distribution roller is, in turn, in contact with a damping medium application roller. The dipping roller has a chrome-plated surface and can be driven at variable circumferential speeds. The transfer roller is coated with caoutchouc and is seated to be freely rotatable and can be placed against the damping medium distribution roller. The damping medium distribution roller is chrome plated and is driven by the plate cylinder through an arrangement of gear teeth. The damping medium application roller has a soft covering and is caused to rotate by frictional contact with the damping medium distribution roller.

A limitation of this prior art damping unit is that printing ink is transferred from the inked printing plates on the plate cylinder, by way of the damping medium application roller, to the several remaining rollers of the damping unit. The ink travels back through the damping unit in the direction toward the damping medium distribution box. This ink is thus deposited on all of the rollers in the damping unit. Since the ink is typically not hydrophilic, its existence on the surfaces of the damping unit rollers will impair the ability of these rollers to effectively transfer damping fluid or damping medium from the damping medium box to the printing plate or plates on the plate cylinder. The result of this is a reduction in the quality of the printed product produced by the rotary printing unit.

It will thus be seen that a need exists for a damping unit that will overcome the limitations of the prior art devices. The damping unit for a printing press in accordance with the present invention provides such a device and is a significant improvement over the prior art.

SUMMARY OF THE INVENTION

It is an object of the present invention to provide a damping unit for a printing press.

Another object of the present invention is to provide a damping unit for a rotary printing press.

A further object of the present invention is to provide a damping unit with at least four rollers for applying a damping medium to a plate cylinder of an offset rotary printing press.

Still another object of the present invention is to provide a damping unit for a rotary printing press which prevents reverse distribution of printing ink.

Yet a further object of the present invention is to provide a damping unit for a rotary printing press in which the damping unit rollers are driven at selected proportional circumferential speeds.

As will be set forth in detail in the description of the preferred embodiment which is presented subsequently, the damping unit for a rotary printing press in accordance with the present invention utilizes a dipping roller to pick up damping medium from a damping medium box. The dipping roller has a hydrophilic surface and is driven by a drive motor. A transfer roller, that has a resilient surface, is in contact with the dipping roller. This transfer roller is also in contact with a damping medium distribution roller that is coated with a damping medium friendly, or accepting hydrophilic material. A damping medium application roller contacts the distribution roller and also contacts the surface of a printing plate or plates on a plate cylinder. The distributing roller is driven to rotate at a circumferential speed which is proportional to, but less than the circumferential speed of the plate cylinder. The circumferential speed of the damping medium distribution roller is also not equal to, and is preferably greater than the circumferential speeds of the transfer roller and of the dipping roller.

The primary advantage of the damping unit in accordance with the present invention is its ability to disrupt the reverse spread or migration of printing ink back from the plate cylinder toward the damping medium reservoir. This disruption of the reverse ink flow or spread takes place because of the difference of the circumferential speed between the damping medium application roller and the damping medium distribution roller. An additional benefit of the present invention is that further homogenization of the damping medium is achieved because of the circumferential speed difference between the damping medium application roller and the damping medium distribution roller. This results in a more even damping of the printing plates on the plate cylinder.

The circumferential speeds of the damping medium application roller and of the plate cylinder are essentially the same. This results in an application of the damping medium onto the printing plates in a gentle, even manner. Such an application of the damping fluid results in improved print quality.

The damping unit for a printing press in accordance with the present invention overcomes the limitations of the prior art. It is a substantial improvement over the prior art devices and an advance in the art.

BRIEF DESCRIPTION OF THE DRAWINGS

While the novel features of the damping unit for a printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
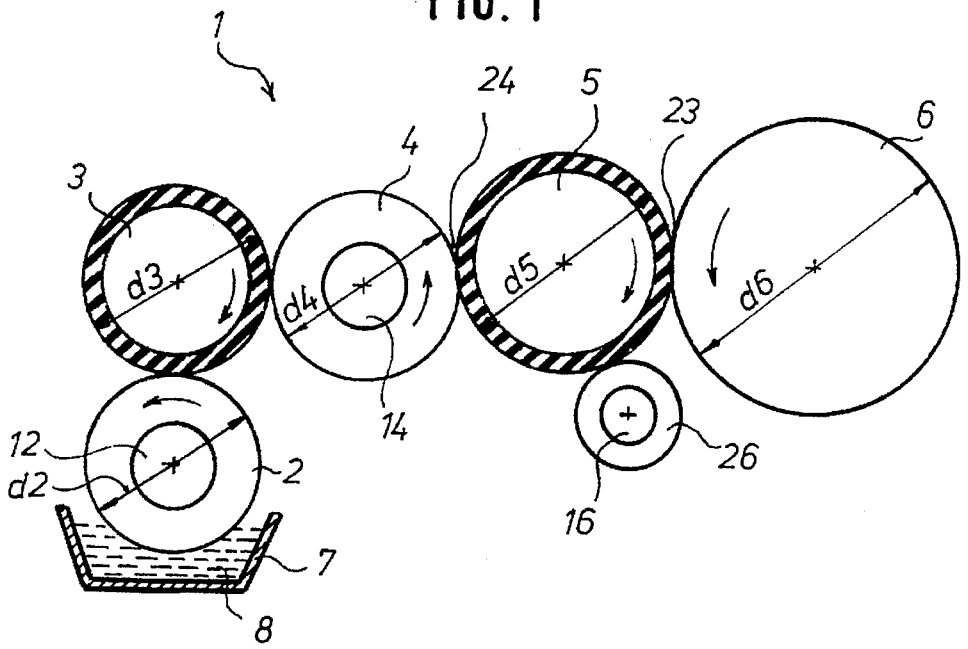
FIG. 1 is a schematic side elevation view, partly in section of a four roller damping unit in accordance with the present invention.

Turning initially to FIG. 1, there may be seen, generally at 1, a four roll damping unit for a printing press in accordance with the present invention. It will be understood that this damping unit 1 will typically be utilized in a rotary printing press that is not shown in detail. It will also be understood that the various rollers, drive gears and cylinders, which will be discussed subsequently, would typically be supported between spaced lateral side frames of the press assembly. These various rollers would also be typically supported between the lateral side frames in eccentric bushing arrangements so that they could be shifted into and out of contact with each other. Since these bushings, side frames, and other features of the printing unit are generally conventional and form no part of the present invention, they will not be discussed in detail.

Again referring primarily to FIG. 1, the four roller damping unit 1 in accordance with the present invention consists of a dipping roller 2, coated with a hydrophilic material, such as, for example, chrome or a ceramic material which may be aluminum oxide or chromium oxide, for example; a transfer roller 3 that is coated with a resilient material, such as caoutchouc; a damping medium distributing roller 4, which can be moved axially back and forth and which has a hydrophilic coating, such as chrome or a ceramic material; and of a damping medium application roller 5 coated with a resilient material such as caoutchouc and which can be placed against a plate cylinder 6. The application roller 5 contacts the plate cylinder 6 in a frictionally connected manner, so that it rotates with approximately the same or with a slightly slower circumferential speed than the plate cylinder 6. The speed of the application roller 5 is preferably approximately 99 to 99.5 percent of the speed of the plate cylinder 6. The rollers 3 and 5 can be coated with a caoutchouc-like resilient plastic material, such as is generally known for use with ink application rollers and other similar rollers.

The dipping roller 2 partially dips into a damping medium box 7 containing a damping medium 8. The dipping roller 2 is driven at one of a plurality of selectively different circumferential speeds by an electric motor 12. The surface of the dipping roller 2 is in contact with the surface of the transfer roller 3. The transfer roller 3 can be driven at a higher circumferential speed than the dipping roller, for example by use of a gear wheel that is fixed on a journal of the transfer roller, and a gear, not shown, at a speed ratio of approximately 3 to 1. It is also possible to equip the transfer roller 3 with a separate, rpm-controlled electric motor drive, not shown, which maintains the ratio of the circumferential speeds of 3:1 between the transfer roller 3 and the dipping roller 2. The transfer roller's circumferential speed will thus be preferably three times the circumferential speed of the dipping roller 2.

Figure 2:
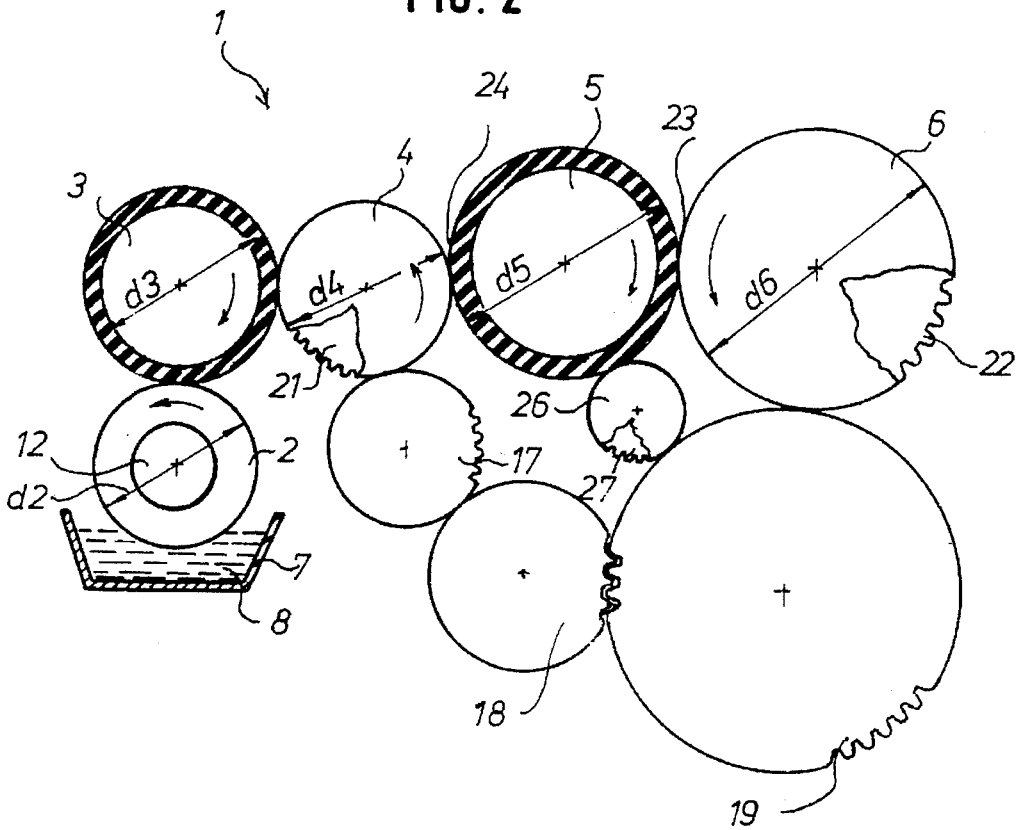
FIG. 2 is a schematic side elevation view, partly in section of the four roller damping unit and showing an alternative drive arrangement for the damping medium distribution roller.

The damping medium distributing roller 4 is driven at a circumferential speed which is less than the circumferential speed of the plate cylinder 6, but which has a proportional relationship with the circumferential speed of the plate cylinder 6. In the first preferred embodiment, the drive for the distribution roller 4 consists of an individual drive, which may be, for example an rpm-controllable gear motor 14, as may be seen in FIG. 1. In a second preferred embodiment, as is shown in FIG. 2, the drive for the damping medium distributing roller 4 consists of a gear wheel train of, for example, three gear wheels 17, 18 and 19. A distributing roller drive gear wheel 21 is connected, in a manner fixed against relative rotation, with a drive journal of the damping medium distributing roller 4, and a plate cylinder gear wheel 22 is connected, in a manner fixed against relative rotation, with a drive journal of the plate cylinder 6. The first gear wheel 17 engages the drive gear wheel 21 of the damping medium distributing roller 4. The third gear wheel 19 engages the drive gear wheel 22 of the plate cylinder 6. In addition, a drive gear of the press acts on the gear wheel 22 of the plate cylinder 6. The second gear wheel 18 of the three gear wheel train is an intermediate gear which is positioned between the first and third gear wheels 17 and 19, respectively. Thus as the plate cylinder 6 is driven by a drive gear of the printing press, which drive gear is not specifically shown, the plate cylinder gear wheel 22 will work through the three gear drive gear train 17, 18 and 19, to effect the rotation of the damping medium distributing roller 4 through the distributing roller gear wheel 21. It will be understood that the circumferential speed of the distributing roller 4 will be based on the speed of the plate cylinder 6 and the relative sizes of the various gears 17, 18, 19, 21 and 22.

The damping medium application roller 5 is placed against the plate cylinder 6 in such a way that it is driven by frictional contact with the plate cylinder 6 wherein, as previously discussed, only very slight frictional losses occur in the circumferential speed of the damping medium application roller 5 with respect to the plate cylinder 6. In accordance with the present invention, it is possible to position a pressure strip on the elastic circumferential surface of the damping medium application roller 5 in a contact space 23 with the pressure strip having a width of between five and eleven millimeters. As seen in FIG. 1, this contact space 23 is between the damping medium application roller 5 and the plate cylinder 6. By means of this contact the result is that the damping medium application roller 5 takes on at least approximately the circumferential speed of the plate cylinder 6 which is typically covered with printing plates. A differential speed is generated in a contact area 24 between the damping medium distributing roller 4 and the damping medium application roller 5. This is because the damping medium distributing roller 4 is positively driven so as to have a lesser circumferential speed, for example 96 percent of the circumferential speed, in respect to the damping medium application roller 5. The contact pressure force of the damping medium distributing roller 4 and the damping medium application roller 5 is selected to be such that the damping medium application roller 5 does not follow the rpm or circumferential speed of the damping medium distributing roller 4, but instead follows the rpm or circumferential speed of the plate cylinder 6o It is also possible, as is shown in FIG. 1, to additionally place a hard, plastic-coated, driven ink distributing roller 26 of an inking unit, not specifically shown, against the damping medium application roller 5 in a frictionally connected manner. This ink distribution roller 26 is driven by means of an rpm-controllable gear motor 16, as is shown in FIG. 1, or by the gear wheel 19 via a gear wheel 27, as shown in FIG.

2. The circumferential speed of the ink distributing roller 26 will be the same or approximately the same as the circumferential speed of the plate cylinder 6.

In the preferred embodiment of the damping unit for a printing press in accordance with the present invention, the diameter d6 of the plate cylinder 6, the diameter d5 of the damping medium application roller 5, the diameter d4 of the damping medium distributing roller 4, the diameter d3 of the transfer roller 3 and the diameter d2 of the dipping roller 2 are interrelated to each other at a diameter ratio of 1 to (0.51 to 0.88) to (0.45 to 0.7) to (0.34 to 0.75) to (0.3 to 0.6). In a preferred embodiment, the diameters d6 to d5 to d4 to d3 to d2 are interrelated to each other at a diameter ratio of 1 to 0.77 to 0.64 to 0.66 to 0.6. Further, in accordance with the present invention, the circumferential speeds of the plate cylinder 6 to the damping medium application roller 5 to the damping medium distributing roller 4 to the transfer roller 3 to the dipping roller 2 are related to each other by the speed ratio of 1 to 1 to (0.4 to 0.99) to (0.25 to 0.4) to (0.08 to 0.18).

In a preferred embodiment, the circumferential speeds of the plate cylinder 6 to the damping medium application roller 5 to the damping medium distributing roller 4 to the transfer roller 3 to the dipping roller 2 have a ratio of 1 to 1 to 0.96 to 0.33 to 0.1. A proportional change of the circumferential speeds of the rollers 2 to 5 occurs every time there is a change of the speed of the press, and thus a change of the speed of the plate cylinder 6.

In accordance with the present invention, it is also possible not to let the dipping roller 2 dip into a damping medium box 7 but instead to apply the damping medium to the dipping roller 2 by means of a known spray damping unit, such as the one in German Patent Publication DE 41 25 012 A1. It is furthermore possible to supplement the roller train, consisting of the dipping roller 2, the transfer roller 3, the damping medium distributing roller 4 and the damping medium application roller 5, by at least one additional hydrophilic roller, not shown, which is disposed between the damping medium distributing roller 4 and the damping medium application roller 5. This additional hydrophilic roller can be friction-driven by the damping medium application roller 5 so that a contact area 24 of a corresponding speed difference of preferably three to four percent is created between the damping medium distributing roller 4 and the additional roller. The direction of rotation of the damping medium distributing roller 4, the transfer roller 3 and the dipping roller 2 must then be reversed by the interposition of the additional roller.

While a preferred embodiment of a damping unit for a printing press in accordance with the present invention has been set forth fully and completely hereinabove, it will be apparent to one of skill in the art that a number of changes in, for example, the composition of the damping medium, the main press drive, the types of bearings and eccentrics used to support the cylinders, rollers, and gears, and the like may be made without departing from the true spirit and scope of the present invention which is accordingly to be limited only by the following claims.

What is claimed is:

1. A damping unit for a printing press comprising:

a dipping roller having a dipping roller diameter and being drivable at a dipping roller circumferential speed, said dipping roller having a hard, hydrophilic surface and being provided with a damping medium from a damping medium source;

a transfer roller having a transfer roller diameter and a transfer roller circumferential speed, said transfer roller circumferential speed being higher than said dipping roller circumferential speed, said transfer roller being engageable with said dipping roller, said transfer roller being coated with a resilient, hydrophilic material;

a damping medium distributing roller having a distributing roller diameter and a distributing roller circumferential speed, said distributing roller circumferential speed being higher than said transfer roller circumferential speed, said distributing roller being engageable with said transfer roller, said distributing roller having a hard, hydrophilic surface;

a damping material application roller having an application roller diameter and an application roller circumferential speed, said application roller circumferential speed being higher than said distributing roller circumferential speed, said application roller being in contact with said distributing roller and with a plate cylinder having a plate cylinder diameter and a plate cylinder circumferential speed, said application roller being coated with a resilient material, said application roller circumferential speed being 99% to 100% of said plate cylinder circumferential speed, said distributing roller circumferential speed being 40% to 99% of said plate cylinder circumferential speed, said transfer roller circumferential speed being 25% to 40% of said plate cylinder circumferential speed and said dipping roller circumferential speed being 8% to 18% of said plate cylinder circumferential speed; and means for driving said distributing roller at said distributing roller circumferential speed.

2. The damping unit of claim 1 wherein a ratio of said plate cylinder diameter to said application roller diameter to said distribution roll diameter to said transfer roll diameter to said dipping roll diameter is in the range of 1 to (0.51 to 0.88) to (0.45 to 0.7) to (0.34 to 0.75) to (0.3 to 0.6).

* * * * *